US006045248A

United States Patent [19]

Ashizawa

[11] Patent Number: 6,045,248

[45] Date of Patent: Apr. 4, 2000

[54] VEHICULAR LAMP

[75] Inventor: Kazuhisa Ashizawa, Shizuoka, Japan

[73] Assignee: Koito Manufacturing Co., Ltd., Tokyo, Japan

[21] Appl. No.: 09/137,828

[22] Filed: Aug. 21, 1998

[30] Foreign Application Priority Data

Sep. 4, 1997 [JP] Japan ..... 9-239370

[51] Int. Cl.[7] ..... F21W 101/02

[52] U.S. Cl. ..... 362/547; 362/294

[58] Field of Search ..... 362/547, 294, 362/345, 373

[56] References Cited

U.S. PATENT DOCUMENTS

| | | | |
|---|---|---|---|
| 4,796,163 | 1/1989 | Dressler | 362/547 |
| 4,931,912 | 6/1990 | Kawakami et al. | 362/547 |
| 5,010,453 | 4/1991 | Ketterman | 362/61 |
| 5,113,320 | 5/1992 | Haydu | 362/547 X |
| 5,285,358 | 2/1994 | Watanabe et al. | 362/61 |
| 5,367,438 | 11/1994 | Deslandres | 362/294 X |
| 5,497,308 | 3/1996 | Ohtsuka et al. | 362/294 |
| 5,611,612 | 3/1997 | Choji et al. | 362/61 |

*Primary Examiner*—Laura K. Tso
*Attorney, Agent, or Firm*—Sughrue, Mion, Zinn, Macpeak & Seas, PLLC

[57] ABSTRACT

Disclosed is a vehicular lamp in which a closed lamp chamber is defined by a lamp body and a front lens, a reflector with a light source attached thereto is disposed apart from the lamp body, and air holes, which are used for the breathing action of the lamp, are formed in the portions of the lamp body located above and below the light source. The vehicular lamp is improved such that a horizontal rib is located inside the lamp body or outside the reflector to block a vertical air stream flowing through a gap between the rear side of the front lens and the lamp body, whereby the amount of air going out and coming in through the air holes is increased (the breathing action is activated) and the dew-formation preventing effect is enhanced.

17 Claims, 9 Drawing Sheets

VEHICULAR LAMP

BACKGROUND OF THE INVENTION

1. Field of the Invention

The present invention relates to a vehicular lamp with breathing air holes formed in the rear wall of a lamp body, which cooperates with a front lens to define a lamp chamber.

2. Related Art

A conventional vehicular lamp of this type is typically illustrated in FIG. 9. The illustrated one is a vehicular headlamp. As shown, a lamp chamber of the headlamp is defined and hermetically closed by a lamp body 1 and a front lens 2. A reflector 3 with a bulb 4 as a light source, inserted thereinto, is supported by an aiming mechanism (not shown) such that it is tiltable back and forth as well as to the right and left. The aiming mechanism is composed of two aiming screws and one ball joint. Breathing air holes 6*a* and 6*b* are formed at positions above and below the bulb 4 set to the rear wall of the lamp body 1, while communicating the inside of the lamp chamber with the outside thereof. The headlamp breathes through the air holes to prevent the dew from being formed on the front lens 2.

When the bulb 4 is turned on, it generates heat. The heat causes air streams by convection (as indicated by arrows A) around the bulb 4. Most of the air streams around the bulb 4 is ascending. As a result, a pressure in the upper portion of the inside of the lamp chamber is higher than in the lower portion. In the upper portion of high pressure air flows out through the air hole 6*a*, while in the lower portion of low pressure air is introduced thereinto from the outside through the air hole 6*b*. In this way, air is discharged from the inside of the lamp chamber to the outside, and sucked thereinto from the outside. In other words, the headlamp breaths through the air holes 6*a* and 6*b*. This breathing action activates the convection current within the lamp chamber to prevent the formation of the dew condensation.

In the headlamp thus constructed, a gap is present between the reflector 3 and the lamp body 1. Air (heated air), which is left after being discharged through the air hole 6*a*, flows downward and returns to the front space of the reflector 3, while passing through that gap (as indicated by an arrow B). Therefore, a reduced amount of air circulates between the inside and outside of the lamp chamber, through the air holes 6*a* and 6*b*, and hence the convection current A also reduces in its amount and the dew prevention effect.

SUMMARY OF THE INVENTION

Accordingly, an object of the present invention is to provide a vehicular lamp which can effectively prevent the dew from being formed on the front lens in a manner that the air circulation passage on the rear side of the reflector is blocked, whereby the breathing action through the air holes of the lamp body is activated.

In a vehicular lamp, a closed lamp chamber is defined by a lamp body and a front lens, a reflector with a light source attached thereto is disposed apart from the lamp body, and air holes, which are used for the breathing action of the lamp, are formed in the portions of the lamp body located above and below the light source. The vehicular lamp is improved such that a horizontal rib is located inside the lamp body or outside the reflector to block a vertical air stream flowing through a gap between the rear side of the front lens and the lamp body.

With such a construction, within the lamp chamber the light source is turned on and heats air, and the resultant heated air flows by convection. The heated air of increased pressure in the upper space within the lamp chamber flows from a place above the reflector and out of the lamp chamber through the upper air hole. In the lower space with the lamp chamber, outside air is introduced into the lamp chamber through the lower air holes. This breathing action activates a convection air current within the lamp chamber, thereby preventing the dew from being formed in the lamp chamber. The heated air in the upper space within the lamp chamber will flow from a place above the reflector and reach the rear side of the reflector, and flow downward. This circulation of the heated air is blocked by the horizontal rib. As a result, the amount of air going out and coming in through the air holes is increased (the breathing action is activated) and the dew-formation preventing effect is enhanced.

Further, in the vehicular lamp of the invention, second horizontal ribs for guiding forward outside air coming in through the lower air holes into the lamp chamber are provided above and near the lower air holes of the lamp body.

The second horizontal ribs guide forward outside air coming in through the lower air holes to the front of the reflector, whereby the convection air current is activated within the lamp chamber. The horizontal rib or ribs extends beyond the reflector.

In this vehicular lamp, a circulating current of heated air along the inner side of the lamp body is blocked with the horizontal rib, and the convection air current within the lamp chamber is further activated. Outside air coming in through the lower air holes is efficiently guided to the front of the reflector by the second horizontal ribs. This contributes to the activation of the air current within the lamp chamber. The horizontal rib or ribs are formed in the lamp body.

The sink marks resulting from the formation of the ribs are possibly formed in the region of the reflector near the horizontal ribs. Therefore, it is not preferable to form the horizontal ribs on the reflector contributing to the formation of the light distribution pattern. The lamp body is independent of the formation of the light distribution pattern. Therefore, if the sink mark is formed on the lamp body, and the lamp body is somewhat deformed, no problem arises. Therefore, the formation of the horizontal ribs on the lamp body is allowed.

Moreover, an air passage, while passing through the reflector, is provided at a position near the upper air hole. With this structure, part of the heated air around the light source flows through the air passage to reach the rear side of the reflector (it does not flow to the rear side of the reflector by way of a place above the reflector), and flows out of the lamp chamber through the upper air hole. Therefore, the length of the flowing-out passage of heated air around the light source is reduced, and the amount of air going out and coming in through the air holes is correspondingly increased (the breathing action is activated).

DESCRIPTION OF THE PREFERRED EMBODIMENT

The preferred embodiment of the present invention will be described with reference to the accompanying drawings.

Figure 1:
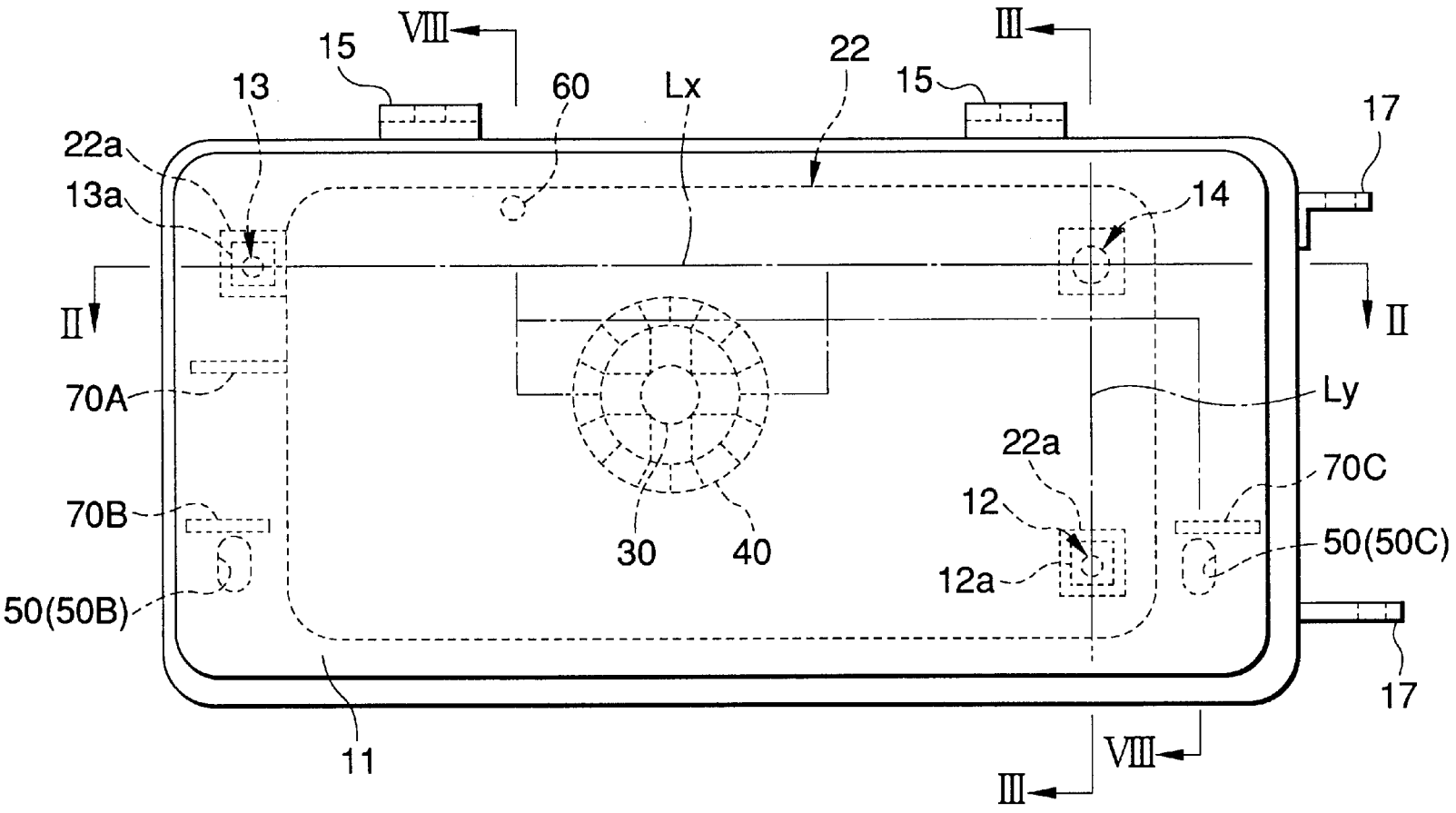
FIG. 1 is a front view showing a vehicular headlamp constructed according to the present invention.
Figure 2:
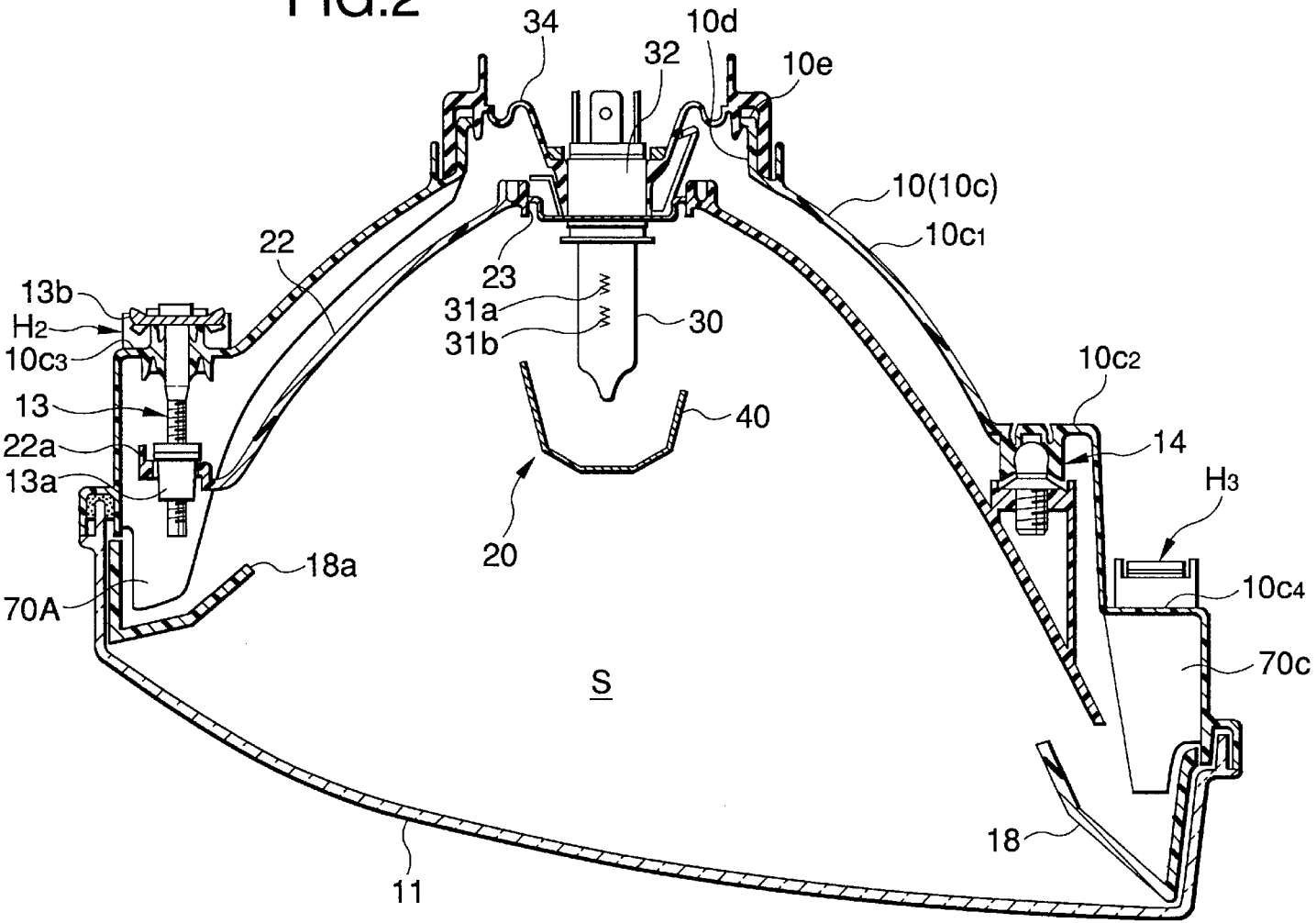
FIG. 2 is a horizontal sectional view showing the headlamp taken along a line II—II in FIG. 1.
Figure 3:
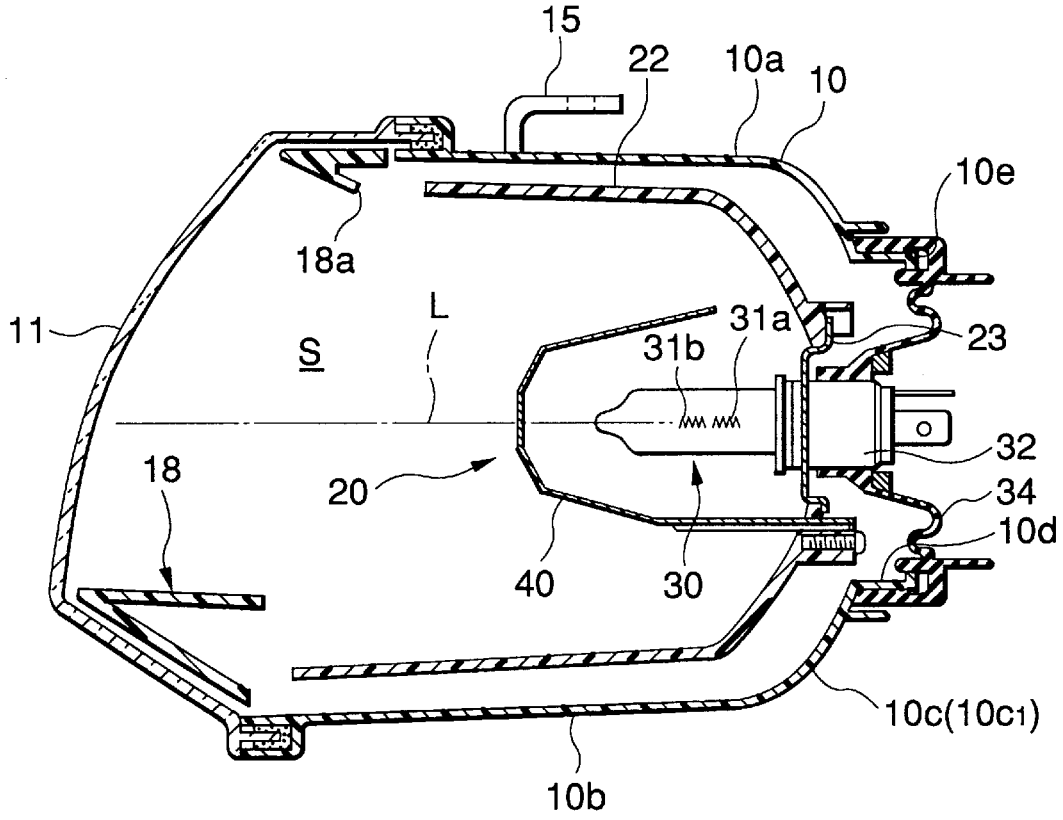
FIG. 3 is a longitudinal sectional view showing the headlamp taken along a line III—III in FIG. 1.
Figure 4:
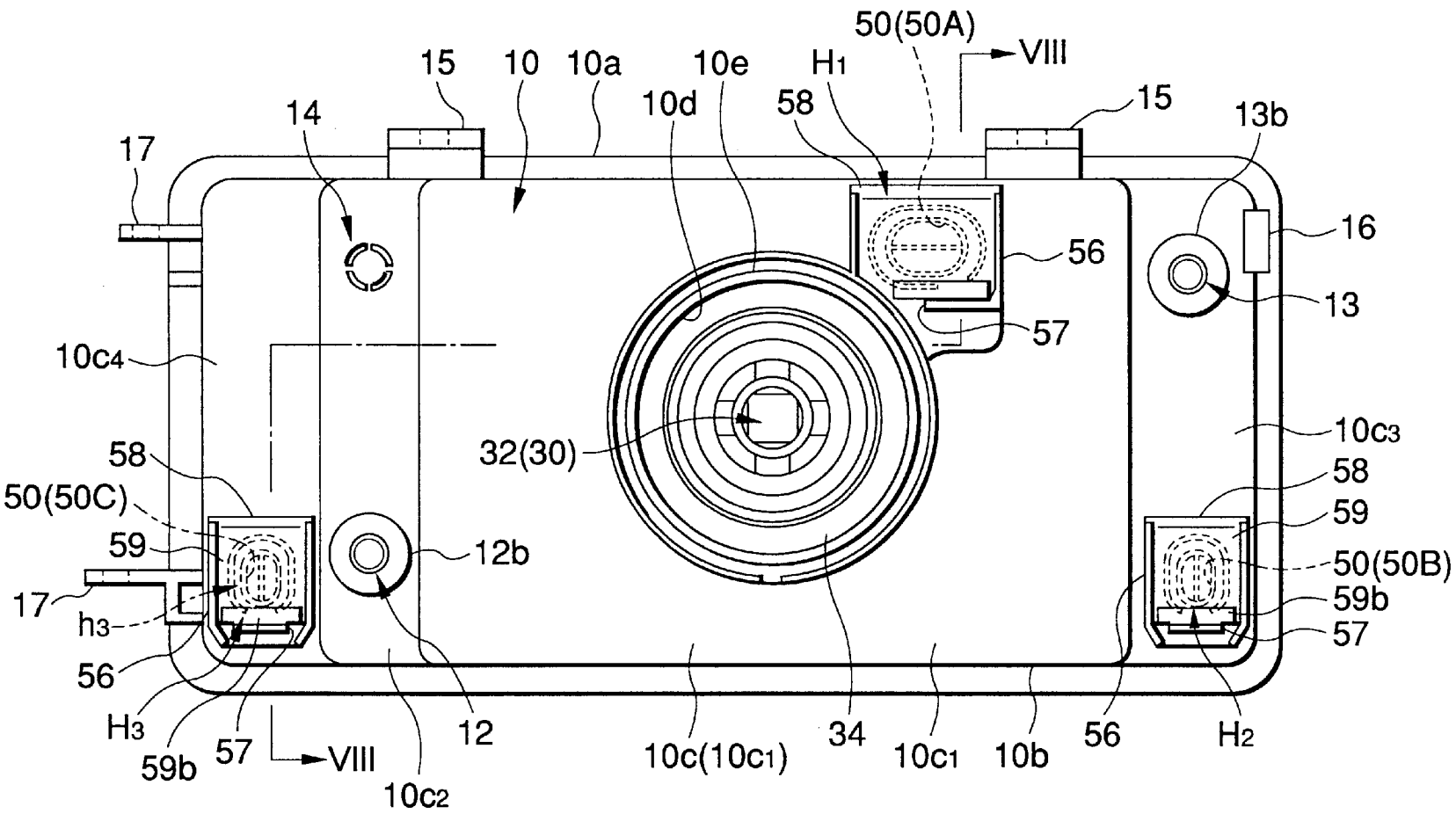
FIG. 4 is a rear view showing the headlamp.
Figure 5:
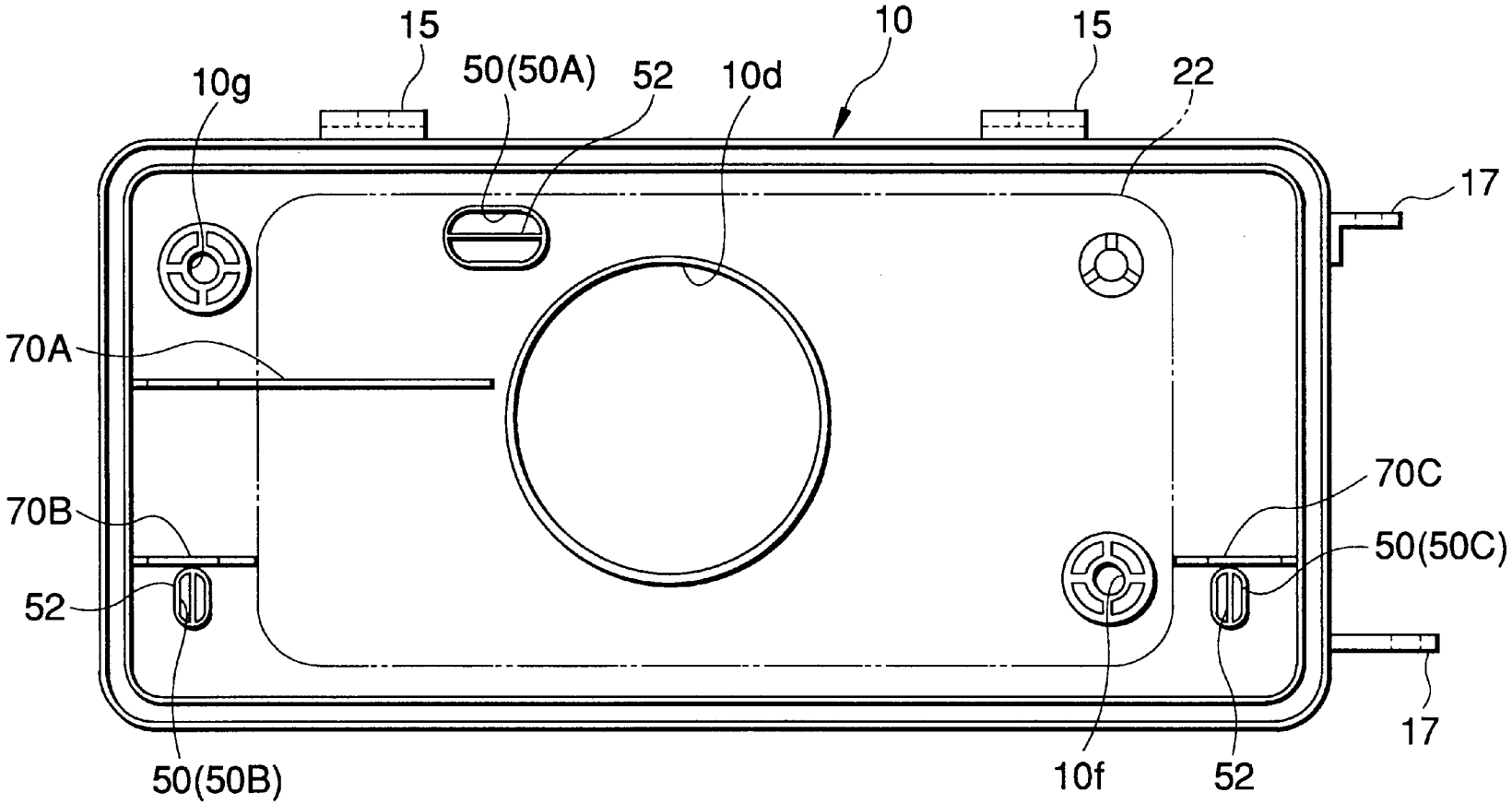
FIG. 5 is a front view showing the lamp body.
Figure 6:
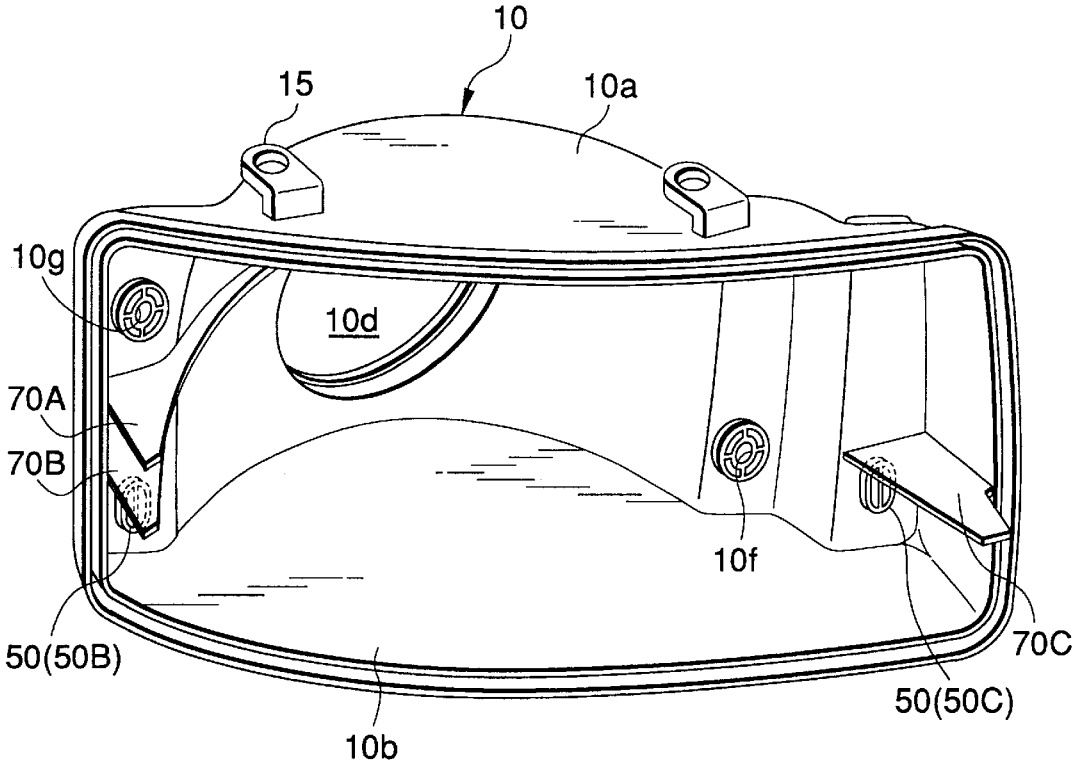
FIG. 6 is a perspective view showing the lamp body.
Figure 7:
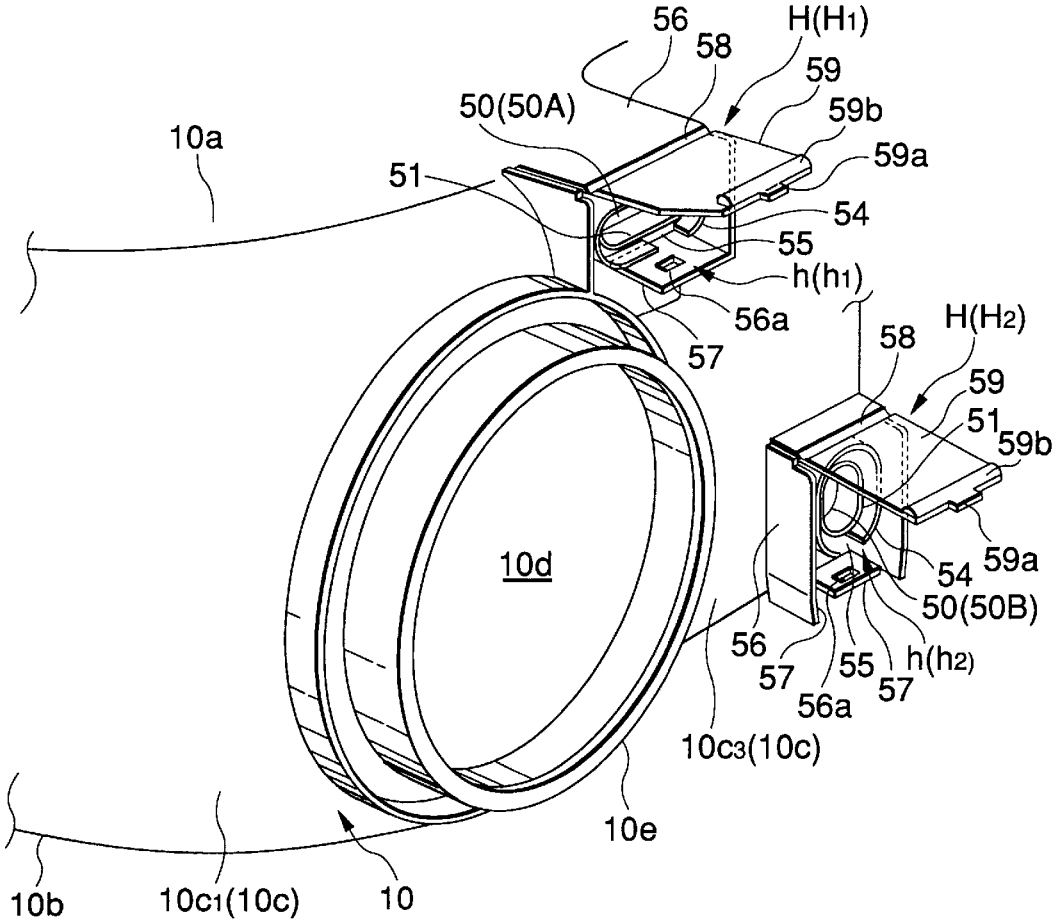
FIG. 7 is a rear view in perspective of the lamp body.
Figure 8:
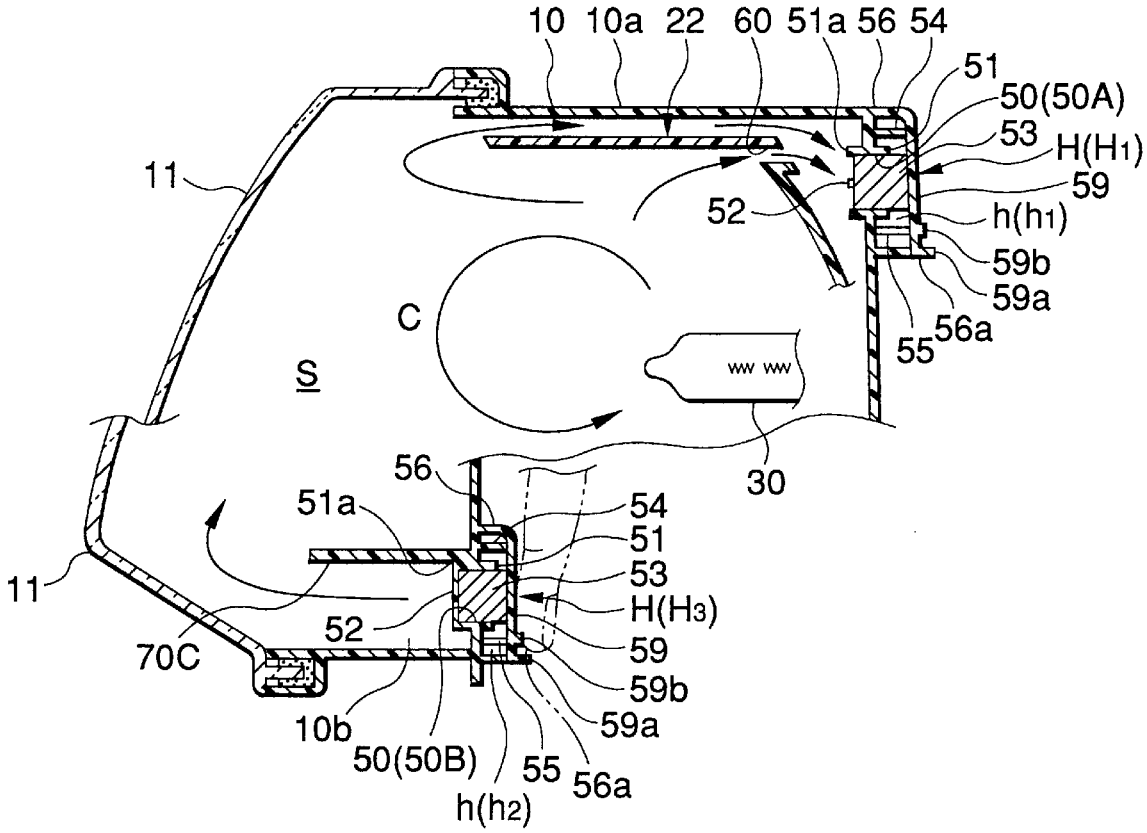
FIG. 8 is a sectional view showing the headlamp taken on line VIII—VIII in FIGS. 1 and 4 useful in explaining the breathing operation through the air holes.
Figure 9:
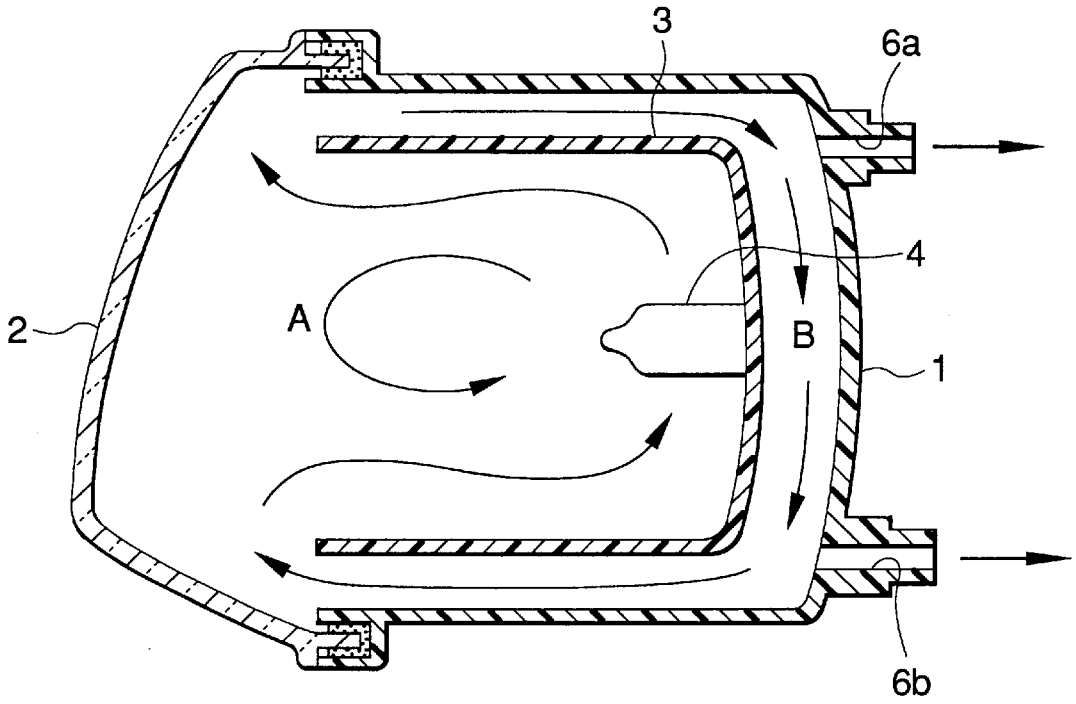
FIG.9 PRIOR ART
FIG. 9 is a longitudinal sectional view showing a conventional vehicular headlamp.

FIGS. 1 through 8 cooperate to show an embodiment of the present invention: FIG. 1 is a front view showing a vehicular headlamp constructed according to the present invention; FIG. 2 is a horizontal sectional view showing the headlamp (taken on line II—II in FIG. 1); FIG. 3 is a longitudinal sectional view showing the headlamp taken alone a line III—III in FIG. 1; FIG. 4 is a rear view showing the headlamp; FIG. 5 is a front view showing the lamp body; FIG. 6 is a perspective view showing the lamp body; FIG. 7 is a rear view in perspective of the lamp body; and FIG. 8 is a sectional view showing the headlamp taken along a line VIII—VIII in FIGS. 1 and 4 useful in explaining the breathing operation through the air holes.

In those figures, a lamp body 10 is made of synthetic resin. The lamp body is rectangular while laterally elongating, and opened expanding from the front in the sideways direction. A transparent, curved front lens 11 is attached to the opening of the front of the lamp body 10, whereby a lamp chamber S is hermetically formed while being laterally rectangular in shape.

A lamp unit 20 for forming a main beam and a low beam is of the reflection type. The lamp unit is tiltably supported by an aiming mechanism formed with two aiming screws 12 and 13 and one ball joint 14.

The lamp unit 20 is constructed with a synthetic resin reflector 22, a bulb 30 and a shade 40. The reflector 22 includes a parabolic reflecting surface deposited with aluminum (mirror processed). The bulb 30 as a light source is inserted into and fixed to a bulb insertion hole 23, which is formed at the rear vertex of the reflector 22. The shade 40, for light distribution control, is fixed to the bulb insertion hole 23 by screw means while covering the front of the bulb 30.

The bulb 30, made of glass, contains a main-beam filament 31*a* and a low-beam filament 31*b*. In a state that the bulb 30 is fixed to the bulb insertion hole 23, the reflector 22 is positioned so as to be focused at a mid position between the filaments 31*a* and 31*b*. The main-beam filament 31*a*, when energized, emits a main beam, and the low-beam filament 31*b*, when energized, emits a low beam.

The lamp body 10 includes an upper wall 10*a*, a lower wall 10*b* and a rear wall 10*c*. A bracket 15 is attached onto the upper wall 10*a*. The lamp body is mounted on a vehicle body by means of the bracket 15. The lower wall 10*b* extends in parallel with the upper wall 10*a*. The rear wall 10*c*, curved rearward, is located between the upper and lower walls 10*a* and 10*b*. An opening 10*d* for bulb replacement is formed in the rear wall 10*c* of the lamp body 10. A bulb socket 32 of the bulb 30 protrudes rearward through the opening 10*d*. A rubber hood 34, expandable, is located between a cylindrical portion 10*e* forming the opening 10*d* and the bulb socket 32, to thereby close the rear opening (bulb replacing opening) 10*d* of the lamp body 10.

The lamp unit 20 is tiltably supported on the lamp body 10 by means of the two aiming screws 12 and 13 and the ball joint 14. The aiming screws 12 and 13 are rotatably supported at screw insertion holes 10*f* and 10*g* formed in the rear wall 10*c* of the lamp body 10. A couple of nuts 12*a* and 13*a*, which are to be screwed into the aiming screws 12 and 13, are mounted onto brackets 22*a* and 22*a*, respectively. Those brackets are protruded from the rear surface of the reflector 22. By turning the aiming screws 12 and 13, the nuts 12*a* and 13*a* are moved forward and backward along the aiming screws 12 and 13, respectively. Through the movements of the nuts, the lamp unit 20 is tilted about the horizontal axis Lx and the vertical axis Ly, whereby the optical axis L of the lamp unit 20 is tilted vertically and horizontally as well.

Crown gears 12*b* and 13*b* are integrally provided at the rear ends of the aiming screws 12 and 13, respectively. The aiming screws 12 and 13 may be turned by turning the crown gears 12*b* and 13*b*, respectively.

An extension reflector 18 ranges from the front opening of the lamp body 10 to the inner side of the front lens 11, and extends along the latter. The extension reflector 18 has an opening 18*a*, which is located corresponding to the reflector 22 of the lamp unit 20. The obverse side of the extension reflector 18 is deposited with aluminum (mirror processed), like the reflector 22. The extension reflector 18 thus mirror processed covers the periphery region of the lamp unit 20, and with provision of the extension reflector 18, the entire surface of the lamp chamber S looks like a uniform mirror surface. In this respect, the look of the headlamp is improved.

Three air holes 50A, 50B and 50C (generally represented by numeral 50) are formed in the rear wall 10*c* of the lamp body 10. Three air passage housings H1, H2 and H3 (generally represented by numeral H) are provided covering the air holes 50. The air holes 50 open into the air passage housings H, respectively. Further, labyrinthine air passages h1, h2 and h3 (generally designated by h), continuous to outside, are formed in the air passage housings H, respectively. Communication between the inside and outside of the lamp chamber S is set up through those air holes 50 and labyrinthine air passages h. With those structures, the headlamp breathes to prevent moisture from being condensed on the front lens 11.

The opening 10*d* for bulb replacement is formed in the rear wall 10*c* as already stated. The rear wall 10*c* includes a central portion 10*c*1, and depressed portions 10*c*2 and 10*c*3 located on both sides of the central portion 10*c*1. The central portion 10*c*1 is curved along the reflector 22. The aiming mechanism and a bracket 16 for fixing the headlamp to the vehicle body, and the like are disposed on those depressed portions 10*c*2 and 10*c*3. A depressed portion 10*c*4 is located on the left side (when viewed from the rear side of the headlamp) of the aiming-mechanism receiving depressed portion 10*c*2. A bracket 17 by which the headlamp is mounted onto the vehicle body) is protruded from the depressed portion 10*c*4. The upper air hole 50A and the air passage housing H1 are provided on the central portion 10*c*1 of the curved rear wall 10*c* of the lamp body. The lower air hole 50B and the air passage housing H2, and the lower air hole 50C and the air passage housing H3 are, respectively, provided on the lower portions of the aiming-mechanism receiving portion (right) 10*c*3 and the bracket-forming depressed portion (left) 10*c*4.

The upper air hole 50A is horizontally elongated. The housing H1 is rectangular extending horizontally, like the enlarged air hole 50A. The housing H1 is provided at a location above and near the bulb-exchange opening 10*d* in the central portion 10*c*1 of the lamp body rear wall. The vertical length of the housing H1 is shorter than the horizontal length thereof. The lower air holes 50B and 50C are vertically elongated. The housings H2 and H3 are rectangular extending vertically, like the enlarged air holes 50B and 50C. The housings H2 and H3 are provided at locations below the bulb-exchange openings 10*d* in the right portion 10*c*3 and the left portion 10*c*4 of the lamp body rear wall. The horizontal length of each of the housings H2 and H3 is shorter than the vertical length thereof.

The bulb 30 is actuated and heats air within the lamp chamber S, and the heated air circulates by convection, as indicated by an arrow C in FIG. 8, around the bulb 30. A pressure in the upper portion of the lamp chamber S increases to be higher than a pressure in the lower portion. The air heated around the bulb 30 flows through a route of the front, upper and rear of the reflector 22, and flows out of the lamp chamber S through the upper air hole 50A. At the same time, outside air is introduced into the lamp chamber S through the lower air holes 50B and 50C. In this way, the headlamp breathes to activate the convection current C and hence to prevent the formation of the dew within the lamp chamber S.

As shown in FIG. 8, an air passage hole 60 is formed in the reflector 22 at a position substantially confronted with the upper air hole 50A. The heated air existing on the inner side of the reflector 22 flows to the upper air hole 50A through two routes, a first route above the reflector 22 and a second route of the air passage hole 60. The second route of the air passage hole 60 is shorter than the first route above the reflector 22. Therefore, its flow resistance is small, the amount of air discharged through the upper air hole 50A increases, and the breathing action is more activated.

The air holes 50 (50A, 50B and 50C) are elongated holes of large opening areas, whereby a sufficient amount of air flows through the lamp chamber S. The following air current is formed within the lamp chamber S: Outside air introduced into the lamp chamber S through the lower air holes 50B and 50C, which are located in the lower portion within the lamp chamber S and closer to the right and left sides of the same, and is discharged out of the lamp chamber S through the upper air hole 50A located at the central position in the upper portion within the lamp chamber S. The unique structure of the invention, which causes the above air current, successfully solves the following problem of the conventional headlamp: The air current C is entirely formed within the lamp chamber S; the heated air insufficiently circulates by convection within the lamp chamber S; and therefore, moisture is liable to be condensed at the corners of the front lens 11.

A horizontal rib 70A extends from the inner side of the rear wall of the lamp body 10. The horizontal rib 70A is provided for blocking the circulation of heated air along the rear wall of the reflector 22. More specifically, the horizontal rib 70A is located between the upper air hole 50A and the lower air hole 50B on the inner side of the rear wall of the lamp body, while horizontally extending beyond the front opening of the lamp body 10 and up to a position in close proximity to the extension reflector 18 (FIGS. 2, 5 and 6). The inner edge of the horizontal rib 70A, shaped along the contour of the rear wall of the reflector 22, extends to a position where it does not interfere with the reflector 22, tiltable, whereby the gap between the reflector 22 and the rear wall 10*c* of the lamp body is reduced. With the provision of the horizontal rib 70A, heated air will flow downward along the rear wall of the reflector 22 within the lamp chamber S; however, the horizontal rib 70A blocks the flow of the heated air. Accordingly, the heated air above the reflector 22 is discharged through the upper air hole 50A, not circulating along the rear wall of the reflector 22. The result is to correspondingly increase the amount of air circulating through the upper air hole 50A and the lower air holes 50B and 50C, and hence to more activate the breathing action.

A couple of second horizontal ribs 70B and 70C, respectively, are provided just above the lower air holes 50B and 50C on the inner side of the rear wall of the lamp body 10. Those second ribs are provided for guiding inward air coming through the lower air holes 50B and 50C. The second horizontal ribs 70B and 70C are shaped in conformity with the contour of the rear wall of the reflector 22, and each of those ribs extends beyond the front opening of the lamp body 10 and up to a position in close proximity to the extension reflector 18, whereby it does not interfere with the reflector 22. With provision of those ribs, outside air is introduced into the lamp chamber S through the lower air holes 50B and 50C, and guided forward by the second horizontal ribs 70B and 70C and flows into the inside of the reflector 22, while not flowing upward through the gap between the reflector 22 and the lamp body 10. As a result, the convection air current C is activated, and the moisture condensation preventing effect is enhanced.

It is noted that the second horizontal ribs 70B and 70C are extended beyond the reflector 22 to positions close to the front lens 11. This unique structure reliably guides outside air, which is introduced into the lamp chamber S through the lower air holes 50B and 50C, to the rear side of the front lens. In this respect, the unique structure solves the problem of the conventional headlamp, viz., moisture is liable to condense into small drops on the lower portion of the front lens.

A cylindrical upstanding wall 51 passing through the rear wall 10*c* of the lamp body 10 forms each air hole 50. The upstanding wall 51 protruded rearward from the rear wall 10*c* almost blocks the entering of dust and water into the air hole 50 located within the upstanding wall 51. Further, a sponge-like filter 53 is put in the upstanding wall 51. The filter 53 enhances the dust-and-water-proof blocking function of the upstanding wall 51.

A rib 52 is provided on the front side of the upstanding wall 51 while extending along each air hole 50. The rib 52 prevents the filter 53 from slipping off the upstanding wall 51 into the lamp chamber S. The rib 52 extends in the lengthwise direction of the air hole (elongated hole) 50, so that the short diameter width of the elongated hole is further reduced and the filter 53 is more reliably held within the upstanding wall 51.

The front end 51*a* of the upstanding wall 51, which forms the air holes 50, protrudes into the lamp chamber S. In other words, the upstanding wall 51 less protrudes to the rear side of the lamp body. Therefore, the air passage housing H, provided covering the upstanding wall 51, also less protrudes correspondingly.

A second upstanding wall 54 and a third upstanding wall 56 are further provided. The second upstanding wall 54 is disposed around the upstanding wall 51 of the rear wall 10*c* of the lamp body. The diameter of the opening of the second upstanding wall 54 is larger than that of the upstanding wall 51. The bottom of the second upstanding wall 54 is cut out in part. The second upstanding wall 54 is higher than the upstanding wall 51. The third upstanding wall 56, rectangular in cross section, is disposed around the second upstanding wall 54. The bottom of the third upstanding wall 56 is cut out in part. The third upstanding wall 56 is higher than the second upstanding wall 54.

It is noted that the cut-outs 55 and 57 of the second and third upstanding walls 54 and 56 are formed in the bottom wall of those upstanding walls. With provision of the cut-outs, even if water enters into the inside spaces of those upstanding walls 54 and 56, it is naturally discharged through those cut-outs.

The cut-outs 55 and 57 of the second and third upstanding walls 54 and 56 are arranged such that those cut-outs are not vertically aligned with each other. Since the upstanding walls are thus arranged on their cut-outs, if water enters through the cut-out 57 of the third upstanding wall 56, it rarely reaches the cut-out 55 of the second upstanding wall 54.

A thinned linear portion serving as a hinge 58 traverses the upper portion of the third upstanding wall 56. A swing cover 59 is extended forward from and along the hinge 58. The swing cover 59 is used for covering the end opening of the third upstanding wall 56. The swing cover 59 has an engaging protrusion 59*a* at its free end. When the swing cover 59 is turned down to close the end opening of the third upstanding wall 56, the engaging protrusion 59*a* engages into an engaging hole 56*a* formed in the lower or bottom portion of the third upstanding wall 56.

The swing cover 59 is turned down about the hinge 58, and the engaging protrusion 59*a* of the swing cover 59 is brought into engagement (lance engagement) with the engaging hole 56*a* of the third upstanding wall 56. Then, the end opening of the third upstanding wall 56 is closed with the swing cover 59, to thereby form the labyrinthine air passages h (h1, h2, h3) which are continuous to the lamp chamber S via the air holes 50 and to the outside of the lamp chamber S, through the cut-out 57. Also in the closing state of the swing cover 59, the dust-blocking filter 53 is pushed by the swing cover 59 and firmly held within the upstanding wall 51.

Thus, the labyrinthine air passages h (h1, h2, h3) allowing the air holes 50 (50*a*, 50B, 50C) to be continuous to exterior are formed by the second upstanding wall 54, the third upstanding wall 56 and the swing cover 59, which form the air passage housings H.

A rib 59*b* with a knob is attached to and along the free end of the swing cover 59. The rib 59*b* is helpful when the swing cover 59 is closed. To close the swing cover 59, the flat of a worker's finger is put on the rib 59*b* to be immovable (as indicated by a phantom line in FIG. 8). Therefore, a pressing force by the finger is efficiently transmitted to the swing cover 59 to bend and turn the swing cover 59, so that the engaging protrusion 59*a* is smoothly fit into the engaging hole 56*a*.

While the present invention is applied to the vehicular headlamp of the tiltable reflector type in the foregoing embodiment, it is evident that the invention is applicable to any vehicular lamp where the reflector is provided apart from the lamp body.

As seen from the foregoing description, in the vehicular lamp of the present invention, when the lamp breathes through the air holes, a stream of heated air which will flow from a place above the reflector to the rear side of the reflector, and then flow downward, is blocked by the horizontal rib. Therefore, the breathing action through the air holes is activated; the convection stream of air is active within the lamp chamber; and the aim of preventing the dew formation within the lamp chamber is achieved.

In the vehicular lamp of the invention, further, outside air which is introduced through the lower air holes is guided into the lamp chamber by the second horizontal ribs. The result is that the convection air current is activated, and no dew is formed within the lamp chamber.

In the vehicular lamp of the invention, moreover, a circulating current of heated air along the inner side of the lamp body is reliably blocked with the horizontal rib, and outside air is efficiently guided to the front of the reflector. The result is also to activate the convection current of air within the lamp chamber and to reliably prevent the dew formation therewithin.

The lower region of the front lens is liable to be fogged with the dew if any measure is not taken. The unique structure of the invention succeed in solving this problem since the second horizontal ribs guides outside air coming in through the lower air holes to the lower regions of the front lens.

The horizontal rib in the lamp body according to the present invention is independent of the light distribution. Therefore, there is no chance that a reflector deformation caused by the sink marks formed thereon adversely affects the light distribution pattern.

The technical idea of the invention reduces the length of the flowing-out passage of heated air around the light source. The amount of air going out and coming in through the air holes is correspondingly increased (the breathing action is activated). The result is to activate the convection current of air within the lamp chamber and to enhance the dew formation preventing effect.

What is claimed is:

1. A vehicular lamp comprising:

a lamp body having a front opening;

a front lens coupled to the front opening of the lamp body;

a closed lamp chamber defined by the lamp body and the front lens;

a reflector disposed within said closed lamp chamber, and spaced from said lamp body so as to form a gap between said lamp body and said reflector;

a light source attached to said reflector;

at least one upper air hole and at least one lower air hole respectively formed in portions of said lamp body located above and below said light source; and at least one horizontal rib protruding from one of said lamp body and said refector, said horizontal rib being disposed in the gap and between said upper air hole and said lower air hole so as to substantially block circulation of heated air along a rear surface of said reflector.

2. The vehicular lamp according to claim 1, further comprising at least one second horizontal rib protruding from a position above and near said lower air hole of said lamp body.

3. The vehicular lamp according to claim 1, wherein said horizontal rib extends beyond said reflector in a direction toward the front opening of said lamp body.

4. The vehicular lamp according to claim 2, wherein said horizontal rib and said second horizontal rib extend beyond said reflector in a direction toward the front opening of said lamp body.

5. The vehicular lamp according to claim 1, wherein said horizontal rib is integrally formed with said lamp body.

6. The vehicular lamp according to claim 2, wherein said horizontal rib and said second horizontal rib are integrally formed with said lamp body.

7. The vehicular lamp according to claim 1, further comprising an air passage penetrating said reflector at a position near said upper air hole.

8. The vehicular lamp according to claim 1, further comprising a filter disposed in at least one of said upper air hole and said lower air hole.

9. The vehicular lamp according to claim 1, further comprising a plurality of lower air holes.

10. The vehicular lamp according to claim 9, further comprising a plurality of second horizontal ribs protruding from at least one of said lamp body and said reflector and being disposed respectively above each of said plurality of lower air holes.

11. The vehicular lamp according to claim 9, wherein said upper air hole is horizontally elongated and wherein each of said plurality of lower air holes are vertically elongated.

12. The vehicular lamp according to claim 1, wherein a cylindrical upstanding wall passing through a rear wall of said lamp body forms each of said at least one upper hole and said at least one lower hole.

13. The vehicular lamp according to claim 12, wherein said cylindrical upstanding wall is protruded rearward from said rear wall to prevent entry of dust and moisture into said closed lamp chamber through said at least one upper hole and said at least one lower hole.

14. The vehicular lamp according to claim 13, wherein a protruded portion of said cylindrical upstanding wall is substantially covered by an air passage housing.

15. The vehicular lamp according to claim 1, wherein said horizontal rib is substantially flat.

16. The vehicular lamp according to claim 10, wherein said horizontal rib and said plurality of second horizontal ribs are substantially flat.

17. A vehicular lamp comprising:

a lamp body having a front opening;

a front lens coupled to the front opening of the lamp body;

a closed lamp chamber defined by the lamp body and the front lens;

a reflector disposed within said closed lamp chamber, and spaced from said lamp body so as to form a gap between said lamp body and said reflector;

a light source attached to said reflector;

at least one upper air hole and at least one lower air hole respectively formed in portions of said lamp body located above and below said light source; and at least one horizontal rib protruding from one of said lamp body and said reflector, said horizontal rib shaped to substantially follow the contour of said one of said lamp body and said reflector, and said horizontal rib extending from a rear portion of said one of said lamp body and said reflector in a direction toward the front opening of said lamp body to a position beyond a front of said reflector.

* * * * *